US009711085B2

(12) United States Patent
Wu

(10) Patent No.: US 9,711,085 B2
(45) Date of Patent: Jul. 18, 2017

(54) PIXEL CIRCUIT HAVING A TESTING MODULE, ORGANIC LIGHT EMITTING DISPLAY PANEL AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventor: Hao Wu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/772,193

(22) PCT Filed: Nov. 7, 2014

(86) PCT No.: PCT/CN2014/090625

§ 371 (c)(1),
(2) Date: Sep. 2, 2015

(87) PCT Pub. No.: WO2016/026218

PCT Pub. Date: Feb. 25, 2016

(65) Prior Publication Data

US 2016/0275860 A1 Sep. 22, 2016

(30) Foreign Application Priority Data

Aug. 22, 2014 (CN) ..... 2014 1 0419203

(51) Int. Cl.

| | |
|---|---|
| ***G09G 3/3233*** | (2016.01) |
| ***G09G 3/00*** | (2006.01) |
| ***G09G 3/3258*** | (2016.01) |

(52) U.S. Cl.
CPC ..... *G09G 3/3233* (2013.01); *G09G 3/006* (2013.01); *G09G 3/3258* (2013.01);
(Continued)

(58) Field of Classification Search
None
See application file for complete search history.

(56) References Cited

U.S. PATENT DOCUMENTS

| | | | | |
|---|---|---|---|---|
| 2007/0152672 | A1 | 7/2007 | Lee | |
| 2013/0100104 | A1* | 4/2013 | Sagawa | G09G 3/3233 345/211 |
| 2014/0320475 | A1* | 10/2014 | Shin | G09G 3/3275 345/212 |

FOREIGN PATENT DOCUMENTS

| | | | |
|---|---|---|---|
| CN | 2006-106122 | A | 4/2006 |
| CN | 202855267 | U | 4/2013 |

(Continued)

OTHER PUBLICATIONS

Definition of testing, google.com, p. 1.*

(Continued)

*Primary Examiner* — Ilana Spar
*Assistant Examiner* — Kirk Hermann
(74) *Attorney, Agent, or Firm* — Ladas & Parry LLP

(57) ABSTRACT

Disclosed are a pixel circuit, an organic light emitting display panel and a display apparatus. The pixel circuit comprises a light emitting device (01), a charging module (02), a driving module (03), and a testing module (04) having a control terminal connected to a test signal terminal (TEST) for providing a test signal switching between a displaying period of time and a testing period of time, a second input terminal (a2) connected to an output terminal of the light emitting device (01), and a third output terminal (b3) connected to a second reference signal terminal (Ref2). Through the pixel circuit, a current signal for driving the (Continued)

light emitting device (01) to emit light can reach the uniformity standard so that display luminance of pixels is uniform and quality of a display picture is ensured.

20 Claims, 4 Drawing Sheets

(52) U.S. Cl.
CPC ..... *G09G 2310/0251* (2013.01); *G09G 2320/0233* (2013.01); *G09G 2320/0626* (2013.01); *G09G 2330/12* (2013.01)

(56) References Cited

FOREIGN PATENT DOCUMENTS

| | | | |
|---|---|---|---|
| CN | 103137051 | A | 6/2013 |
| CN | 103247278 | A | 8/2013 |
| CN | 103943066 | A | 7/2014 |
| CN | 103971640 | A | 8/2014 |

OTHER PUBLICATIONS

International Search Report Appln. No. PCT/CN2014/090625; Dated May 15, 2015.
Written Opinion of the International Searching Authority Appln. No. 05-15-2015.

* cited by examiner

PIXEL CIRCUIT HAVING A TESTING MODULE, ORGANIC LIGHT EMITTING DISPLAY PANEL AND DISPLAY APPARATUS

TECHNICAL FIELD

The present disclosure relates to a pixel circuit, an organic light emitting display panel and display apparatus.

BACKGROUND

An organic light emitting display (OLED) is one of hot topics in the research field of flat panel display. Compared with a liquid crystal display, OLED has advantages of low power consumption, low production cost, self-luminescent, broad view angle and fast response speed and so on. At present, in the display field such as mobile phone, PDA and digital camera and the like, OLED has taken the place of the traditional LCD display screen. Unlike that LCD controls luminance by using a stable voltage, OLED is current-driven and a stable current is required to control light emitting.

At present, for a known pixel circuit that drives OLED to emit light, due to manufacturing processes, device aging and so on, non-uniformity exists in a threshold voltage of a driving transistor of a pixel circuit, thereby resulting in that a change occurs in the current flowing through OLED of each pixel point such that display luminance is non-uniform, which influences display effect of the entire image.

Therefore, how to ensure the uniformity of the current for driving the light emitting device OLED in the display apparatus so as to ensure the quality of the display picture is an urgent problem to be solved by those skilled in the art.

SUMMARY

There is provided in embodiments of the present disclosure a pixel circuit, an organic light emitting display panel and a display apparatus, which are used to solve the problem existing in the prior art that a current for driving a light emitting device OLED in the display apparatus has poor uniformity and display luminance is non-uniform.

There is provided in an embodiment of the present disclosure a pixel circuit, comprising a light emitting device, a charging module, a driving module, and a testing module;

wherein an input terminal of the charging module is connected to a data signal terminal, a control terminal thereof is connected to a scan signal terminal, and an output terminal thereof is connected to a first input terminal and a first output terminal of the testing module respectively;

a control terminal of the driving module is connected to a second output terminal of the testing module, an input terminal thereof is connected to a first reference signal terminal, and an output terminal thereof is connected to an input terminal of the light emitting device; and a control terminal of the testing module is connected to a test signal terminal, a second input terminal thereof is connected to an output terminal of the light emitting device, and a third output terminal thereof is connected to a second reference signal terminal, wherein the testing signal terminal is used to provide a test signal switching between a displaying period of time and a testing period of time.

During the displaying period of time, the testing module is configured to connect the output terminal of the charging module with the control terminal of the driving module and connect the second reference signal terminal with the output terminal of the light emitting device, so that the charging module provides a driving voltage signal to the driving module under the control of the scan signal terminal, and the driving module drives the light emitting device to emit light under the control of the driving voltage signal.

During the testing period of time, the testing module is configured to connect the output terminal of the light emitting device with the output terminal of the charging module, so that the charging module outputs a current signal of the light emitting device to the data signal terminal under the control of the scan signal terminal.

In a possible implementation, in the pixel circuit provided in the embodiment of the present disclosure, the testing module can comprise: a first switching transistor, and a second switching transistor and a third switching transistor which has a same doping polarity; and the first switching transistor have a doping polarity inverse to the second switching transistor and the third switching transistor respectively;

wherein a gate of the first switching transistor, a gate of the second switching transistor and a gate of the third switching transistor are connected to the test signal terminal respectively;

a source of the first switching transistor and a source of the third switching transistor are connected to the output terminal of the light emitting device respectively;

a drain of the first switching transistor and a source of the second switching transistor are connected to the output terminal of the charging module respectively;

a drain of the second switching transistor is connected to the control terminal of the driving module; and a drain of the third switching transistor is connected to the second reference signal terminal.

In a possible implementation, in the pixel circuit provided in the embodiment of the present disclosure, the charging module can comprise a fourth switching transistor;

wherein a gate of the fourth switching transistor is connected to the scan signal terminal, a source thereof is connected to the data signal terminal, and a drain thereof is connected to the first input terminal and the first output terminal of the testing module.

In a possible implementation, in the pixel circuit provided in the embodiment of the present disclosure, the driving module can comprise: a storage capacitor and a fifth switching transistor;

wherein a source of the fifth switching transistor is connected to the first reference signal terminal, a gate thereof is connected to the second output terminal of the testing module, and a drain thereof is connected to the input terminal of the light emitting device;

when the fifth switching transistor is P type transistor, the storage capacitor is connected in parallel between the source and the gate of the fifth switching transistor; and when the fifth switching transistor is an N type transistor, the storage capacitor is connected in parallel between the drain and the gate of the fifth switching transistor.

There is provided in an embodiment of the present disclosure an organic light emitting display panel, comprising a plurality of the pixel circuits provided in the embodiment of the present disclosure arranged in array.

There is provided in an embodiment of the present disclosure a display apparatus, comprising the organic light emitting display panel provided in the embodiment of the present disclosure.

In a possible implementation, in the display apparatus provided in the embodiment of the present disclosure, it is further comprised: a test controlling unit connected to a test signal terminal through a test signal line, and a compensation processing unit and a driving unit connected to a data signal terminal through a data line;

wherein the test controlling unit is configured to provide a test signal switching between a displaying period of time and a testing period of time to the test signal terminal;

the compensation processing unit is configured to determine a compensation voltage signal for the respective pixel circuits according to a current signal received from the data signal terminal during the testing period of time during the testing period of time and transmit the compensation voltage signal to the driving unit; and the driving unit is configured to superpose the compensation voltage signal transmitted by the compensation processing unit and a data signal received from a signal source and then transmit the superposed signals to the data signal terminal.

In a possible implementation, in the display apparatus provided in the embodiment of the present disclosure, the compensation processing unit and the driving unit are integrated on a same chip.

There are provided in the embodiments of the present disclosure a pixel circuit, an organic light emitting display panel and a display apparatus. A testing module is added to the pixel circuit. The testing module receives the test signal switching between the displaying period of time and the testing period of time, and is configured to connect the output terminal of the charging module with the control terminal of the driving module during the displaying period of time and connect the second reference signal terminal with the output terminal of the light emitting device, so that the charging module provides the driving voltage signal to the driving module under the control of the scan signal terminal, and the driving module drives the light emitting device to emit light under the control of the driving voltage signal, thereby realizing the function of emitting light normally. This testing module is further configured to connect the output terminal of the light emitting device with the output terminal ermine of the charging module during the testing period of time, so that the charging module outputs the current signal of the light emitting device to the data signal terminal under the control of the scan signal terminal, and then an external compensation processing unit determines the compensation voltage signal for the respective pixel circuits according to the current signal received by the data signal terminal, and the driving unit transmits the compensation voltage signal determined by the compensation processing unit and the data signal received from the signal source to the data signal terminal after superposing them. By providing a compensated driving voltage signal for the driving module through the charging module, an external compensation function is realized, which finally realizes that the current signal for driving the light emitting device in each pixel achieves the uniformity standard, so that display luminance of each pixel is uniform and the quality of the display picture is ensured.

DETAILED DESCRIPTION

Specific implementations of a pixel circuit, an organic light emitting display panel and a display apparatus provided in embodiments of the present disclosure will be described in detail by combining with accompanying figures.

Figure 1:
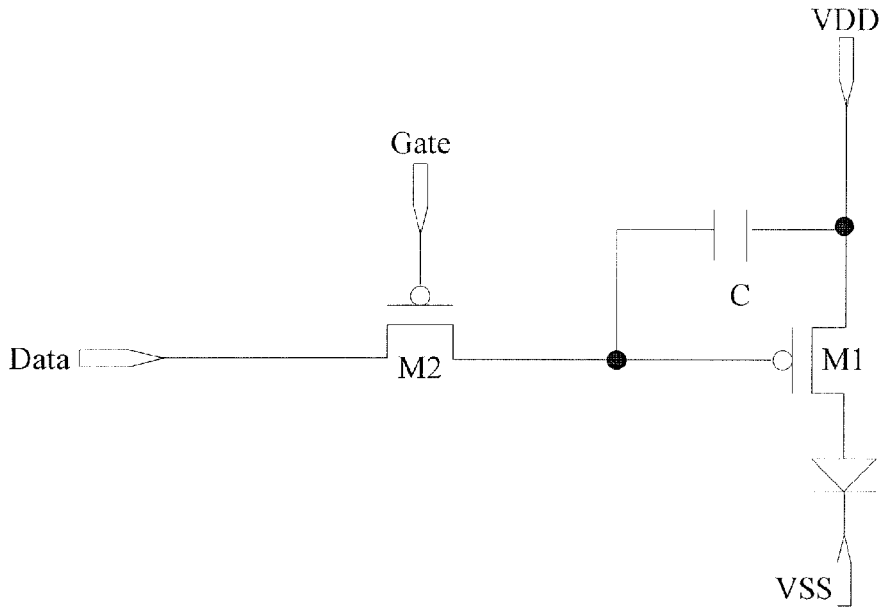
FIG. 1 is a schematic diagram of a configuration of a known pixel circuit.

FIG. 1 is a schematic diagram of a configuration of a known pixel circuit. As shown in FIG. 1, the pixel circuit driving OLED to emit light comprises: a driving transistor M1, a second switching transistor M2, a storage capacitor C and a light emitting device OLED; wherein a gate of the driving transistor M1 is connected to a drain of the second switching transistor M2 and one terminal of the storage capacitor C respectively, a source thereof is connected to the other terminal of the storage capacitor C and a high voltage signal terminal VDD, and a drain thereof is connected to one terminal of the light emitting device OLED; a gate of the switching transistor M2 is connected to a scan signal terminal Gate, and a drain thereof is connected to a data signal terminal Data; the other terminal of the light emitting device OLED is connected to a low voltage signal terminal VSS. When the driving transistor M1 drives the light emitting device OLED to emit light, a driving current is controlled by the high voltage signal terminal VDD, the data signal terminal Data and the driving transistor M1 jointly. The driving transistor M1 cannot be made completely consistent in the manufacturing process thereof, and non-uniformity exists in a threshold voltage $V_{th}$ of the driving transistor M1 in the respective pixel circuits due to manufacturing process and device aging and so on, which result in a change occurring in a current flowing through OLED of each pixel point, so that the display luminance is non-uniform, thereby influencing the display effect of the entire image.

Figure 2:
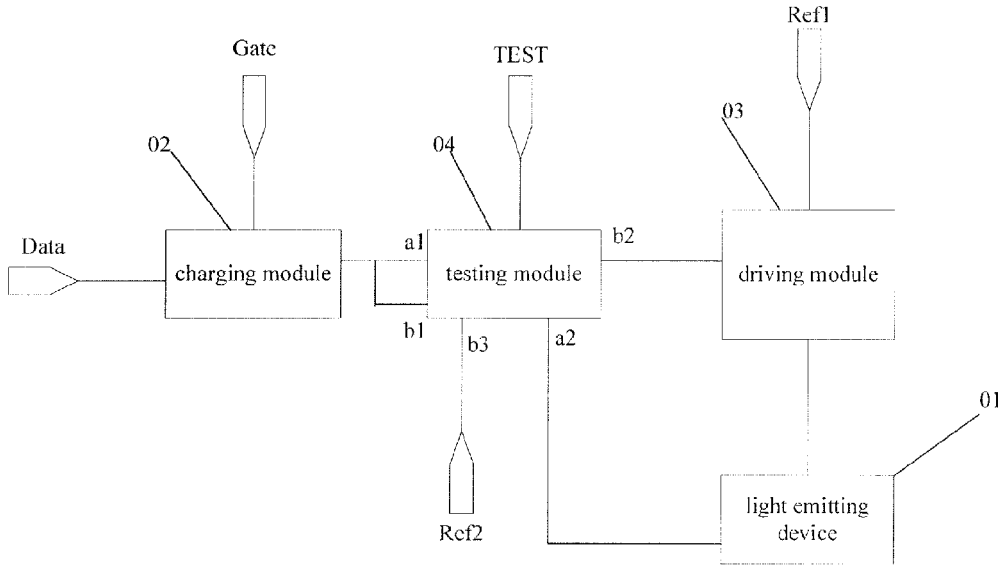
FIG. 2 is a schematic diagram of a configuration of a pixel circuit provided in an embodiment of the present disclosure.

FIG. 2 shows a schematic diagram of a configuration of a pixel circuit provided in an embodiment of the present disclosure. As shown in FIG. 2, the pixel circuit in the embodiment of the present disclosure comprises: a light emitting device 01, a charging module 02, a driving module 03, and a testing module 04.

In the pixel circuit as shown in FIG. 2, an input terminal of the charging module 02 is connected to the data signal terminal Data, a control terminal thereof is connected to the scan signal terminal Gate, and an output terminal thereof is connected to a first input terminal a1 and a first output terminal b1 of the testing module 04 respectively.

A control terminal of the driving module 03 is connected to a second output terminal b2 of the testing module 04, an input terminal thereof is connected to a first reference signal terminal Ref1, and an output terminal thereof is connected to an input terminal of the light emitting device 01.

A control terminal of the testing module 04 is connected to a test signal terminal TEST. A second input terminal a2 of the testing module 04 is connected to an output terminal of the light emitting device 01. third output terminal b3 of the testing module 04 is connected to a second reference signal terminal Ref2. The test signal terminal TEST is used to provide a test signal switching between a displaying period of time and a testing period of time.

Alternatively, during the displaying period of time, the testing module 04 can be configured to connect the output terminal of the charging module 02 with the control terminal of the driving module 03 and connect the second reference signal terminal Ref2 with the output terminal of the light emitting device 01, so that the charging module 02 provides a driving voltage signal to the driving module 03 under the control of the scan signal terminal Gate, and the driving module 03 drives the light emitting device 01 to emit light under the control of the driving voltage signal.

Alternatively, during the testing period of time, the testing module 04 can be configured to connect the output terminal of the light emitting device 01 with the output terminal of the charging module 02, so that the charging module 02 outputs a current signal of the light emitting device 01 to the data signal terminal Data under the control of the scan signal terminal Gate.

In the pixel circuit provided in the embodiment of the present disclosure, a testing module 04 is added. The testing module 04 receives the test signal switching between the displaying period of time and the testing period of time, and is configured to connect the output terminal of the charging module 02 with the control terminal of the driving module 03 during the displaying period of time, and connect the second reference signal terminal Ref2 with the output terminal of the light emitting device 01, so that the charging module 02 provides the driving voltage signal to the driving module 03 under the control of the scan signal terminal Gate, and the driving module 03 drives the light emitting device 01 to emit light under the control of the driving voltage signal, thereby realizing the function of emitting light normally. The testing module 04 is further configured to connect the output terminal of the light emitting device 01 with the output terminal of the charging module 02 during the testing period of time, so that the charging module 02 outputs the current signal of the light emitting device 01 to the data signal terminal Data under the control of the scan signal terminal Gate, which provides a flowing path for the current signal of the light emitting device 01 to flow into the data signal terminal Data to complete the testing. Thus, it ensures to finally realize that the current signal for driving the light emitting device in each pixel achieves the uniformity standard, so that the display luminance of each pixel is uniform, thereby ensuring the quality of the display picture.

Figure 3A:
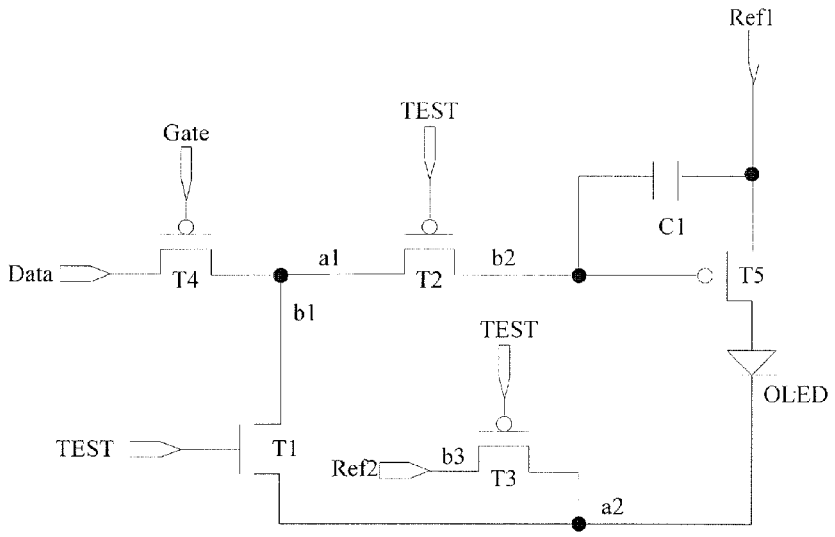
FIG. 3*a* is a schematic diagram of an exemplary configuration of a pixel circuit provided in an embodiment of the present disclosure.
Figure 4A:
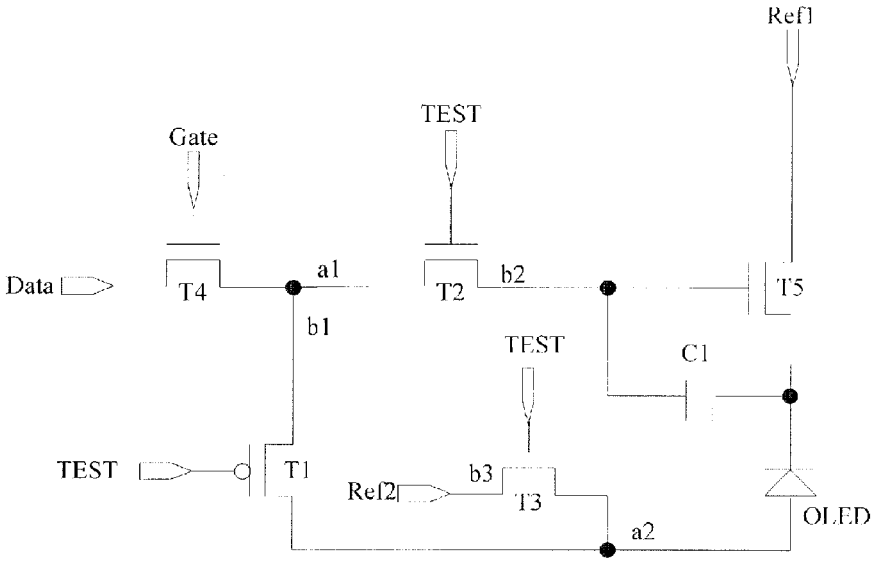
FIG. 4*a* is a schematic diagram of another exemplary configuration of a pixel circuit provided in an embodiment of the present disclosure.

As shown in FIGS. 3*a* and 4*a*, the testing module 04 in the pixel circuit provided in the embodiment of the present disclosure can comprise: a first switching transistor T1, and a second switching transistor T2 and a third switching transistor T3 which have the same doping polarity; the first switching transistor T1 has a doping polarity inverse to the second switching transistor T2 and the third switching transistor T3.

In the embodiment as shown in FIGS. 3*a* and 4*a*, a gate of the first switching transistor T1, a gate of the second switching transistor T2 and a gate of the third switching transistor T3 are connected to the test signal terminal TEST respectively;

a source of the first switching transistor T1 and a source of the third switching transistor T3 are connected to the output terminal of the light emitting device;

a drain of the first switching transistor T1 and a source of the second switching transistor T2 are connected to the output terminal of the charging module 02 respectively;

a drain of the second switching transistor T2 is connected to the control terminal of the driving module 03; and a drain of the third switching transistor T3 is connected to a second reference signal terminal Vss.

Figure 3B:
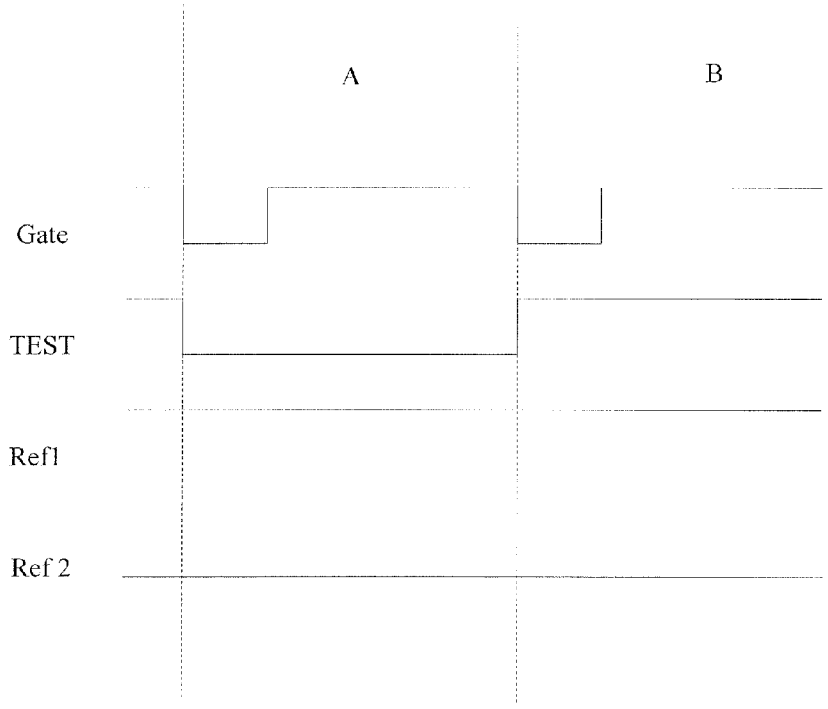
FIG. 3*b* is an exemplary operation timing diagram of the configuration of the pixel circuit as shown in FIG. 3*a* provided in an embodiment of the present disclosure.
Figure 4B:
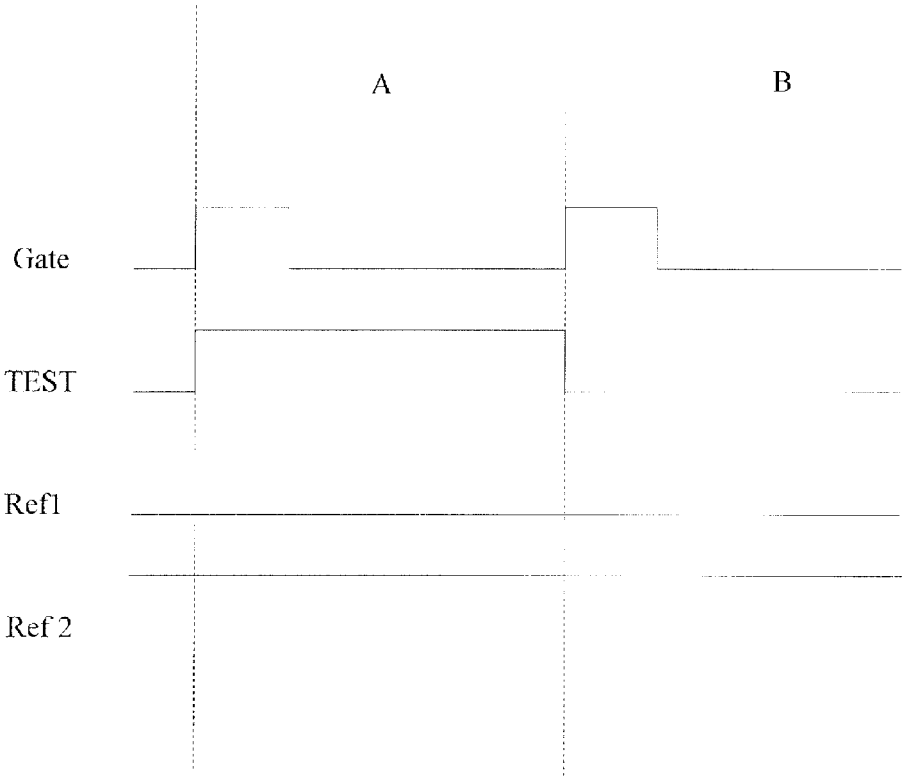
FIG. 4*b* is an exemplary operation timing diagram of the configuration of the pixel circuit as shown in FIG. 4*a* provided in an embodiment of the present disclosure.

Specifically, when the testing module 04 is composed by adopting the first switching transistor T1, the second switching transistor T2 and the third switching transistor T3, by combining with the operation timing diagrams as shown in FIGS. 3*b* and 4*b*, where FIGS. 3*b* and 4*b* are specific to scan pixel circuits of one row, it has the following operating principle: during a displaying period of time A, the test signal terminal TEST is inputted a test signal to control the first switching transistor T1 to be in a turn-off state and control the second switching transistor T2 and the third switching transistor 13 to be in a turn-on state, so that the charging module 02 outputs the driving voltage signal to the driving module 03, and the driving module 03 drives the light emitting device 01 to emit light under the control of the driving voltage signal. During a testing period of time B, the test signal terminal TEST is inputted a test signal having a polarity inverse to the test signal inputted during the displaying period of time A to control the first switching transistor T1 to be in the turn-on state and control the second switching transistor T2 and the third switching transistor T3 to be in the turn-off state, so that the current signal of the light-emitting device 01 flows into the output terminal of the charging module 02, and the charging module 02 outputs the current signal of the light emitting device 01 to the data signal terminal Data under the control of the scan signal terminal Gate, that is, current flowing directions in the pixel circuit during the displaying period of time A and the testing period of time B are inverse to each other to provide the flowing path of the current signal in order to complete the testing of the driving current signal and the external compensation, which finally realizes that the current signal for driving the light emitting device 01 in each pixel achieves the uniformity standard, so that the display luminance of each pixel is uniform, thereby ensuring the quality of the display picture.

In the pixel circuit provided in the embodiment of the present disclosure, the testing module 04 has to complete different operations during the displaying period of time A and the testing period of time B, and thus it requires that the first switching transistor T1 has a doping type inverse to the second switching transistor T2 and the third switching transistor T3 respectively. Specifically, as shown in FIG. 3*a*, the first switching transistor T1 can be set as an N type transistor, while the second switching transistor T2 and the third switching transistor T3 can be set as P type transistors. In this configuration, as shown in FIG. 3*b*, it requires that the test signal terminal TEST is inputted a low level signal during the displaying period of time A to control the first switching transistor T1 to be in the turn-off state and control the second switching transistor T2 and the third switching transistor T3 to be in the turn-on state, and that the test signal terminal TEST is inputted a high level signal during the testing period of time B to control the first switching transistor T1 to be in the turn-on state and control the second switching transistor T2 and the third switching transistor T3 to be in the turn-off state. Also, as shown in FIG. 4*a*, the first switching transistor T1 is set as the P type transistor, while the second switching transistor T2 and the third switching transistor T3 are set as the N type transistor. In this configuration, as shown in FIG. 4*b*, it requires that the test signal terminal TEST is inputted the high level signal during the displaying period of time A to control the first switching transistor T1 to be in the turn-off state and control the second switching transistor T2 and the third switching transistor T3 to be in the turn-on state, and that the test signal terminal TEST is inputted the low level signal during the testing period of time B to control the first switching transistor T1 to be in the turn-on state and control the second switching transistor T2 and the third switching transistor 13 to be in the turn-off state. In this way, the first switching transistor T1, the second switching transistor 12 and the third switching transistor T3 are turned on at different times under the control of the test signal terminal TEST to complete functions of the testing module 04 during different periods of time.

As shown in FIGS. 3*a* and 4*a*, in the pixel circuit provided in the embodiment, the charging module 02 can comprise: a fourth switching transistor 14, whose gate is connected to the scan signal terminal Gate, source is connected to the data signal terminal Data, and drain is connected to the first input terminal a1 and the first output terminal b1 of the testing module 04.

Specifically, the fourth switching transistor T4 can be the P type transistor as shown in FIG. 3*a*. Also, the fourth switching transistor T4 can be the N type transistor as shown in FIG. 4*a*, to which no limitation is made herein.

When the fourth switching transistor T4 is manufactured by adopting the P type transistor, as shown in FIG. 3*b*, during the displaying period of time A, the scan signal terminal Gate is inputted the low level signal to control the fourth switching transistor T4 to be in the turn-on state, and the turned-on fourth switching transistor T4 outputs the driving voltage signal of the data signal terminal Data to the control terminal of the driving module 03 through the testing module 04, so that the driving module 03 drives the light emitting device 01 to emit light under the control of the driving voltage signal, thereby realizing the function of emitting light normally; during the testing period of time B, the scan signal terminal Gate is still inputted the low level signal to control the fourth switching transistor T4 to be in the turn-on state, and the turned on fourth switching transistor T4 outputs the current signal of the light emitting device 01 outputted by the testing module 04 to the data signal terminal Data, which provides the flowing path for the current signal of the light emitting device 01 to flow into the data signal terminal Data to complete the testing.

When the fourth switching transistor T4 is manufactured by adopting the N type transistor, as shown in FIG. 4*b*, during the displaying period of time A and the testing period of time B, the scan signal terminal Gate is inputted the high level signal to control the fourth switching transistor T4 to be in the turn-on state, and the function completed by the turned on fourth switching transistor T4 during the displaying period of time A and the testing period of time B is the same as that completed by the fourth switching transistor T4 when it is manufactured by adopting the P type transistor. The repeated description is not given herein.

As shown in FIGS. 3*a* and 4*a*, in the pixel circuit provided in the embodiment of the present disclosure, the driving module 03 can comprise: a storage capacitor C1 and a fifth switching transistor T5; a source of the fifth switching transistor T5 is connected to the first reference signal terminal Ref1, a gate thereof is connected to the second output terminal b2 of the testing module 04, and a drain thereof is connected to the input terminal of the light emitting device 01; when the fifth switching transistor T5 is the P type transistor, the storage capacitor C1 is connected in parallel between the source and the gate of the fifth switching transistor T5; when the fifth switching transistor T5 is the N type transistor, the storage capacitor C1 is connected in parallel between the drain and the gate of the fifth switching transistor T5. Specifically, during the displaying period of time A, the fifth switching transistor T5 drives the light emitting device 01 to emit light under the control of the driving voltage signal; during the testing period of time B, since the storage capacitor C1 is discharged to provide the driving voltage signal to the fifth switching transistor T5, the fifth switching transistor T5 is still in the turn-on state and drives the light emitting device 01 to emit light continuously.

It should be noted that the switching transistors described in the embodiment of the present disclosure can be thin film transistors (TFT) or can be metal oxide semiconductors (MOS), to which no limitation is made herein. In the specific implementation, sources and drains of these transistors can be exchanged with each other, and no specific distinction is made between these sources and drains.

It should be noted that the pixel circuit provided in the embodiment of the present disclosure can realize the function of external compensation, or can be applicable to a pixel circuit having the function of internal compensation, so that compensation for the threshold voltage of the driving transistor is realized. Its implementation and operating principle are similar to the above pixel circuit provided in the embodiments of the present disclosure, and thus the repeated description is not given herein.

Based on the same disclosed concept, there is provided in an embodiment of the present disclosure an organic light emitting display panel, comprising a plurality of pixel circuits provided in the embodiment of the present disclosure arranged in array. Since the organic light emitting display panel has a principle for solving the problem similar to the pixel circuit, the implementation of the organic light emitting display panel can refer to the implementation of the pixel circuit. Thus, the repeated description is not further given herein.

Based on the same disclosed concept, there is provided in an embodiment of the present disclosure a display apparatus, comprising the organic light emitting display panel provided in the embodiment of the present disclosure. The display apparatus can be any product or components having the displaying function, such as a mobile phone, a tablet computer, a TV set, a display device, a notebook computer, a digital photo frame, and a navigator and so on. Since the display apparatus has a principle for solving the problem similar to the organic light emitting display panel, the implementation of the display apparatus can refer to the implementation of the organic light emitting display panel. Thus, the repeated description is not further given herein.

Figure 5:
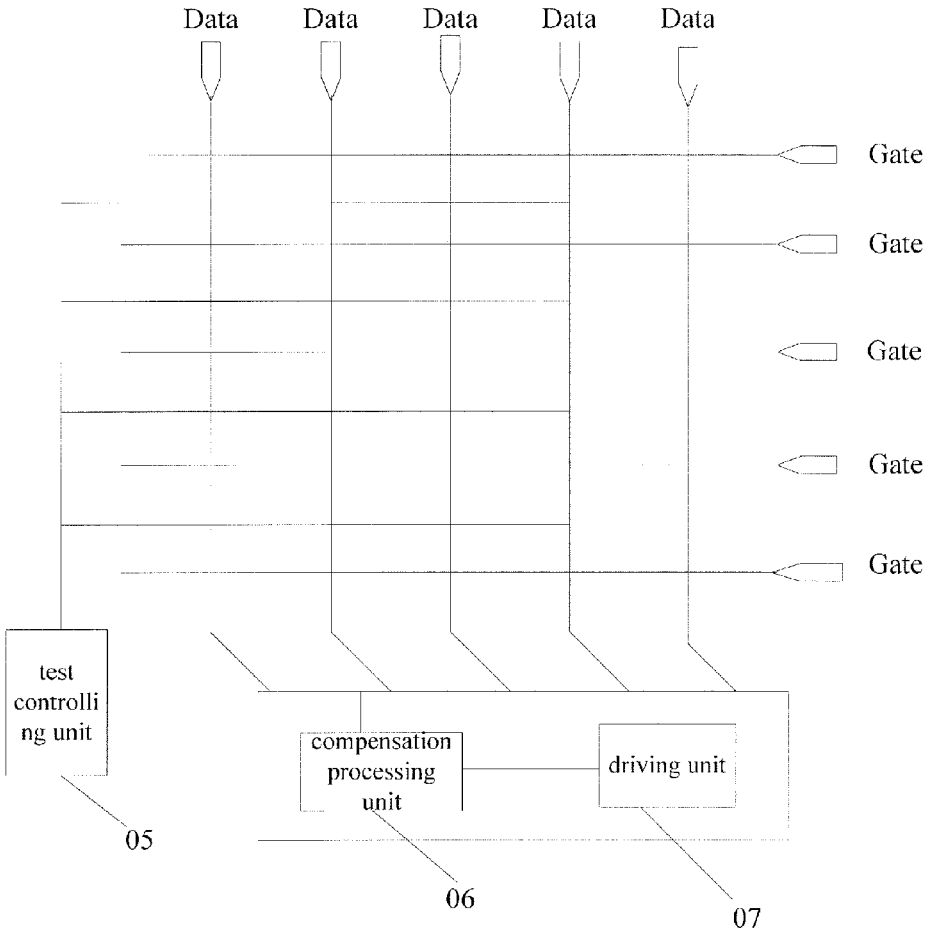
FIG. 5 is a schematic diagram of a configuration of a display apparatus provided in an embodiment of the present disclosure.

FIG. 5 shows a schematic diagram of a configuration of the display apparatus provided in the embodiment of the present disclosure. As shown in FIG. 5, in the specific implementation, besides comprising the organic light emitting display panel provided in the embodiment of the present disclosure, the display apparatus provided in the embodiment of the present disclosure can further comprise:

a test controlling unit 05 connected to the test signal terminal TEST through the test signal line, and a compensation processing unit 06 and a driving unit 07 connected to the data signal terminal Data through the data line;

wherein the test controlling unit 05 is configured to provide a test signal switching between the displaying period of time and the testing period of time to the test signal terminal TEST;

the compensation processing unit 06 is configured to determine a compensation voltage signal for the respective pixel circuits according to the current signal received by the data signal terminal Data during the testing period of time and transmit the compensation voltage signal to the driving unit 07; and the driving unit 07 is configured to superpose the compensation voltage signal transmitted by the compensation processing unit 06 and the data signal received from the signal source and then transmit the superposed signals to the data signal terminal Data.

Specifically, in the display apparatus provided in the embodiment of the present disclosure, during the displaying period of time, the charging module 02 in the pixel circuit provides the driving voltage signal to the driving module 03 through the testing module 04 to control the driving module 03 to drive the light emitting device 01 to emit light, thereby realizing the function of emitting light normally; during the testing period of time, the current signal outputted by the output terminal of the light emitting device 01 flows through the testing module 04 to reach the output terminal of the charging module 02, and the charging module 02 outputs the current signal to the data signal terminal Data under the control of the scan signal terminal Gate, so that the compensation processing unit 06 determines the compensation voltage signal for the respective pixel circuits according to the current signal received from the data signal terminal Data, and the driving unit 07 superpose the compensation voltage signal determined by the compensation processing unit 06 and the data signal received from the signal source and then transmit them to the data signal terminal Data, thereby realizing the function of compensating.

For example, in the display apparatus provided in the embodiment of the present disclosure, during the testing period of time, the compensation processing unit 06, is used, by combining with the gating effect of the scan signal terminal Gate, to determine a corresponding compensation voltage signal according to the current signal received by the data signal terminal Data of each pixel unit, and for the pixel unit whose compensation voltage signal is determined, external compensation is realized through the driving unit 07, and then the current of each pixel unit is tested again until the current of all the pixel units reaches the uniformity standard. At this time, a compensation parameter is written into the driving unit 07, for example, the pixel units in the N-th column and the N-th row need a compensation voltage signal of −0.1V, then in the subsequent pixel driving process, the driving voltage signal of the pixel unit is maintained a reduction of 0.1V. In this way, the driving current of the respective pixel units reaching the uniformity standard is finally realized, and the uniformity of the display luminance of pixels is ensured, so that the quality of the display picture is ensured.

In the specific implementation, in the display apparatus provided in the embodiment of the present disclosure, the compensation processing unit 06 and the driving unit 07 can be integrated on a same chip. Specifically, in the design of a product, the test controlling unit 05, the compensation processing unit 06 and the driving unit 07 can also be integrated on the same chip. Such a design is advantageous for realizing a simultaneous control of all the pixels by using the smallest occupation space, to avoid that an aperture ratio of the product is affected, the arrangement space is saved, and the production cost is reduced.

There are provided in the embodiments of the present disclosure a pixel circuit, an organic light emitting display panel and a display apparatus. A testing module is added to the pixel circuit. The testing module receives the test signal switching between the displaying period of time and the testing period of time, and is configured to connect the output terminal of the charging module with the control terminal of the driving module during the displaying period of time, and connect the second reference signal terminal with the output terminal of the light emitting device, so that the charging module provides the driving voltage signal to the driving module under the control of the scan signal terminal, and the driving module drives the light emitting device to emit light under the control of the driving voltage signal, thereby realizing the function of emitting light normally. The testing module is further configured to connect the output terminal of the light emitting device with the output terminal of the charging module during the testing period of time, so that the charging module outputs the current signal of the light emitting device to the data signal terminal under the control of the scan signal terminal, and then the external compensation processing unit determines the compensation voltage signal for the respective pixel circuits according to the current signal received by the data signal terminal, and the driving unit superpose the compensation voltage signal determined by the compensation processing unit and the data signal received from the signal source and then transmit the superposed signals to the data signal terminal. By providing a compensated driving voltage signal for the driving module through the charging module, the external compensation function is realized, and the current signal for driving the light emitting device in each pixel achieving the uniformity standard is finally realized, so that display luminance of each pixel is uniform, thereby ensuring the quality of the display picture.

Obviously, those skilled in the art can make various alternations and modifications to the embodiments of the present disclosure without departing from the spirit and scope of the present disclosure. As such, if these alternations and modifications to the embodiments of the present disclosure belong to the scope of the claims as well as their equivalent technology, then the present disclosure intends to include these alternations and modifications.

The present application claims the priority of a Chinese patent application No. 201410419203.4 filed on Aug. 22, 2014. Herein, the content disclosed by the Chinese patent application is incorporated in full by reference as a part of the present disclosure.

What is claimed is:

1. A pixel circuit, comprising: a light emitting device, a charging module, a driving module, and a testing module;

wherein an input terminal of the charging module is connected to a data signal terminal, a control terminal thereof is connected to a scan signal terminal, and an output terminal thereof is connected to a first input terminal and a first output terminal of the testing module respectively;

a control terminal of the driving module is connected to a second output terminal of the testing module, an input terminal thereof is connected to a first reference signal terminal, and an output terminal thereof is connected to an input terminal of the light emitting device; and a control terminal of the testing module is connected to a test signal terminal, a second input terminal thereof is connected to an output terminal of the light emitting device, and a third output terminal thereof is connected to a second reference signal terminal, wherein the testing signal terminal is used to provide a test signal switching between a displaying period of time and a testing period of time;

wherein the testing module comprises: a first switching transistor, and a second switching transistor and a third switching transistor which have a same doping polarity, and the first switching transistor has a doping polarity inverse to the second switching transistor and the third switching transistor respectively.

2. The pixel circuit according to claim 1, wherein during the displaying period of time, the testing module is configured to connect the output terminal of the charging module with the control terminal of the driving module, and connect the second reference signal terminal with the output terminal of the light emitting device, so that the charging module provides a driving voltage signal to the driving module under the control of the scan signal terminal, and the driving module drives the light emitting device to emit light under the control of the driving voltage signal.

3. The pixel circuit according to claim 2, wherein during the testing period of time, the testing module is configured to connect the output terminal of the light emitting device with the output terminal of the charging module, so that the charging module outputs a current signal of the light emitting device to the data signal terminal under the control of the scan signal terminal.

4. The pixel circuit according to claim 2, wherein a gate of the first switching transistor, a gate of the second switching transistor and a gate of the third switching transistor are connected to the test signal terminal respectively;

a source of the first switching transistor and a source of the third switching transistor are connected to the output terminal of the light emitting device respectively;

a drain of the first switching transistor and a source of the second switching transistor are connected to the output terminal of the charging module;

a drain of the second switching transistor is connected to the control terminal of the driving module; and a drain of the third switching transistor is connected to the second reference signal terminal.

5. The pixel circuit according to claim 1, wherein during the testing period of time, the testing module is configured to connect the output terminal of the light emitting device with the output terminal of the charging module, so that the charging module outputs a current signal of the light emitting device to the data signal terminal under the control of the scan signal terminal.

6. The pixel circuit according to claim 5, wherein a gate of the first switching transistor, a gate of the second switching transistor and a gate of the third switching transistor are connected to the test signal terminal respectively;

a source of the first switching transistor and a source of the third switching transistor are connected to the output terminal of the light emitting device respectively;

a drain of the first switching transistor and a source of the second switching transistor are connected to the output terminal of the charging module;

a drain of the second switching transistor is connected to the control terminal of the driving module; and a drain of the third switching transistor is connected to the second reference signal terminal.

7. The pixel circuit according to claim 1, wherein a gate of the first switching transistor, a gate of the second switching transistor and a gate of the third switching transistor are connected to the test signal terminal respectively;

a source of the first switching transistor and a source of the third switching transistor are connected to the output terminal of the light emitting device respectively;

a drain of the first switching transistor and a source of the second switching transistor are connected to the output terminal of the charging module;

a drain of the second switching transistor is connected to the control terminal of the driving module; and a drain of the third switching transistor is connected to the second reference signal terminal.

8. The pixel circuit according to claim 7, wherein the first switching transistor is an N type transistor, while the second switching transistor and the third switching transistors are P type transistors; or the first switching transistor is the P type transistor, while the second switching transistor and the third switching transistor are N type transistors.

9. The pixel circuit according to claim 7, wherein the charging module comprises: a fourth switching transistor;

wherein a gate of the fourth switching transistor is connected to the scan signal terminal, a source thereof is connected to the data signal terminal, and a drain thereof is connected to the first input terminal and the first output terminal of the testing module.

10. The pixel circuit according to claim 7, wherein the driving module comprises: a storage capacitor and a fifth switching transistor;

a source of the fifth switching transistor is connected to the first reference signal terminal, a gate thereof is connected to the second output terminal of the testing module, and a drain thereof is connected to the input terminal of the light emitting device;

when the fifth switching transistor is the P type transistor, the storage capacitor is connected in parallel between the source and the gate of the fifth switching transistor; and when the fifth switching transistor is the N type transistor, the storage capacitor is connected in parallel between the drain and the gate of the fifth switching transistor.

11. An organic light emitting display (OLED) panel, comprising a plurality of the pixel circuits according to claim 1 arranged in array.

12. A display apparatus, comprising the organic light emitting display panel according to claim 11.

13. The display apparatus according to claim 12, further comprising: a test controlling unit connected to a test signal terminal through a test signal line, and a compensation processing unit and a driving unit connected to a data signal terminal through a data line;

wherein the test controlling unit is configured to provide a test signal switching between a displaying period of time and a testing period of time to the test signal terminal;

the compensation processing unit is configured to determine a compensation voltage signal for the respective pixel circuits according to a current signal received from the data signal terminal during the testing period of time and transmit the compensation voltage signal to the driving unit; and the driving unit is configured to superpose the compensation voltage signal transmitted by the compensation processing unit and a data signal received from a signal source and then transmit the superposed signals to the data signal terminal.

14. The display apparatus according to claim 13, wherein the compensation processing unit and the driving unit are integrated on a same chip.

15. The OLED panel according to claim 11, wherein during the displaying period of time, the testing module is configured to connect the output terminal of the charging module with the control terminal of the driving module, and connect the second reference signal terminal with the output terminal of the light emitting device, so that the charging module provides a driving voltage signal to the driving module under the control of the scan signal terminal, and the driving module drives the light emitting device to emit light under the control of the driving voltage signal.

16. The OLED panel according to claim 11, wherein during the testing period of time, the testing module is configured to connect the output terminal of the light emitting device with the output terminal of the charging module, so that the charging module outputs a current signal of the light emitting device to the data signal terminal under the control of the scan signal terminal.

17. The OLED panel according to claim 11, wherein a gate of the First switching transistor, a gate of the second switching transistor and a gate of the third switching transistor are connected to the test signal terminal respectively;

a source of the first switching transistor and a source of the third switching transistor are connected to the output terminal of the light emitting device respectively;

a drain of the first switching transistor and a source of the second switching transistor are connected to the output terminal of the charging module;

a drain of the second switching transistor is connected to the control terminal of the driving module; and a drain of the third switching transistor is connected to the second reference signal terminal.

18. The OLED panel according to claim 17, wherein the first switching transistor is an N type transistor, while the second switching transistor and the third switching transistors are P type transistors; or the first switching transistor is the P type transistor, while the second switching transistor and the third switching transistor are N type transistors.

19. The OLED panel according to claim 17, wherein the charging module comprises: a fourth switching transistor;

wherein a gate of the fourth switching transistor is connected to the scan signal terminal a source thereof is connected to the data signal terminal, and a drain thereof is connected to the first input terminal and the first output terminal of the testing module.

20. The OLED panel according to claim 17, wherein the driving module comprises: a storage capacitor and a fifth switching transistor;

a source of the fifth switching transistor is connected to the first reference signal terminal, a gate thereof is connected to the second output terminal of the testing module, and a drain thereof is connected to the input terminal of the light emitting device;

when the fifth switching transistor is the P type transistor, the storage capacitor is connected in parallel between the source and the gate of the fifth switching transistor; and when the fifth switching transistor is the N type transistor, the storage capacitor is connected in parallel between the drain and the gate of the fifth switching transistor.

* * * * *